US005233400A

United States Patent [19]

Cahill

[11] Patent Number: 5,233,400

[45] Date of Patent: Aug. 3, 1993

[54] WRINKLE PREVENTING REGISTRATION MECHANISM

[75] Inventor: David F. Cahill, Rochester, N.Y.

[73] Assignee: Eastman Kodak Company, Rochester, N.Y.

[21] Appl. No.: 812,147

[22] Filed: Dec. 23, 1991

[51] Int. Cl.[5] ..... G03G 21/00

[52] U.S. Cl. ..... 355/317; 355/309; 271/245

[58] Field of Search ..... 355/309, 317; 271/242, 271/243, 245, 246

[56] References Cited

U.S. PATENT DOCUMENTS

| | | | |
|---|---|---|---|
| 3,957,366 | 5/1976 | Taylor et al. | 355/317 |
| 4,135,804 | 1/1979 | Schoppe et al. | 355/315 |
| 4,515,357 | 6/1985 | Hamlin | 271/245 |
| 4,669,853 | 6/1987 | Sosinski et al. | 355/309 |
| 4,674,736 | 6/1987 | Tsubo | 271/245 |
| 4,842,574 | 6/1989 | Noble et al. | 271/246 |

*Primary Examiner*—Michael L. Gellner
*Assistant Examiner*—P. Stanzione
*Attorney, Agent, or Firm*—Lawrence P. Kessler

[57] ABSTRACT

A registration mechanism for registering a moving receiver sheet relative to a toner image on a moving image bearing member in an electrostatographic reproduction apparatus. The registration mechanism includes members which define a sheet travel path, a registration gate, and a device for feeding the sheet to the registration gate. The registration mechanism also includes sheet deflecting members for deflecting the sheet in a zigzag manner between the sheet feeding device and the registration gate, so as to increase the beam strength of such sheet 10 Claims, 5 Drawing Sheets

WRINKLE PREVENTING REGISTRATION MECHANISM

BACKGROUND OF THE INVENTION

1. Field of the Invention

This invention relates to sheet registration mechanisms for selectively registering sheets being moved seriatim in a reproduction apparatus such as a copier or printer.

2. Description Relative to the Prior Art

Reproduction apparatus such as copiers and printers are known for making copies of an original document or image on individual sheets or substrates. The substrates or sheets are either cut from a continuous supply thereof into desired sizes, or are precut and stored in a hopper for such use. In either case, the individual sheets or substrates are fed seriatim along a sheet travel path for receiving a toner image from a moving image bearing surface for example of an imaging web or drum. Since the image bearing web or drum is moving relative to the moving individual sheet or substrate, the movement of such sheet or substrate must be synchronized and coordinated with the movement of the web or drum in order to insure correct and acceptable registration of the toner image with the sheet or substrate.

3. Description Relative to the Prior Art

For registering the sheet or substrate to the toner image, various types of sheet registration mechanisms are well known including for example those having means for buckling the sheet during such registration. Examples of the latter are disclosed in U.S. Pat. No. 3,957,366 issued May 18, 1976 to Taylor et al., No. 4,135,804 issued Jan. 23, 1979 to Schoppe et al., and No. 4,669,853 issued Jun. 2, 1987 to Sosinski et al. In these types of buckling registration mechanisms, the lead edge of the sheet to be registered is fed by first sheet feeding means along a sheet path against a releasable stop member that is mounted less than the intrack dimension of the sheet from the first sheet feeding means. The stop member is suitable for stopping and aligning such lead edge. Continued feeding of the sheet after the lead edge is stopped then causes the sheet to buckle against the stop member and into an open buckling area which adjoins and opens from one surface of the sheet path. The stop member typically is positioned immediately upstream of a second sheet feeding means which then feeds the registered sheet following a timed and registered release of such sheet by the stop member.

Although buckling of the sheet as above is intended to prevent skewing of the sheet when fed by the second feeding means, significant skewing however at times still occurs, particularly at the second or downstream sheet feeding means. Such significant skewing causes parts of some of the sheets to bend and fold noticeably in a substantially transverse direction to the direction of sheet travel. Such bending and folding results in undesirable wrinkling of the sheet as the sheet is being fed by the second or post registration sheet feeding means.

SUMMARY OF THE INVENTION

In accordance with the present invention, a registration mechanism is provided for use in an electrostatographic reproduction apparatus. The registration mechanism includes means defining a sheet travel path, and first and second sheet feeding means which relative to sheet travel are mounted upstream and downstream respectively for feeding a sheet along the sheet travel path. The registration mechanism also includes releasable stop means positioned within the sheet travel path immediately upstream of the second sheet feeding means for stopping and aligning the lead edge of the sheet. In order to prevent skewing and wrinkling of the sheet, the registration mechanism includes sheet path zigzagging means located within the sheet travel path between the first sheet feeding means and the releasable stop means for increasing the beam strength of a sheet feeding into said second sheet feeding means.

BRIEF DESCRIPTION OF THE DRAWINGS

In the detailed description of the invention presented below, reference is made to the drawings, in which.

DETAILED DESCRIPTION OF THE PREFERRED EMBODIMENT

Because electrostatographic reproduction apparatus or machines such as copiers and printers are well known, the present description will be directed in particular to elements, for example of a printer, which form part of or cooperate more directly with the present invention. Elements not specifically shown or described herein are assumed selectable from those known in the prior art.

Figure 1:
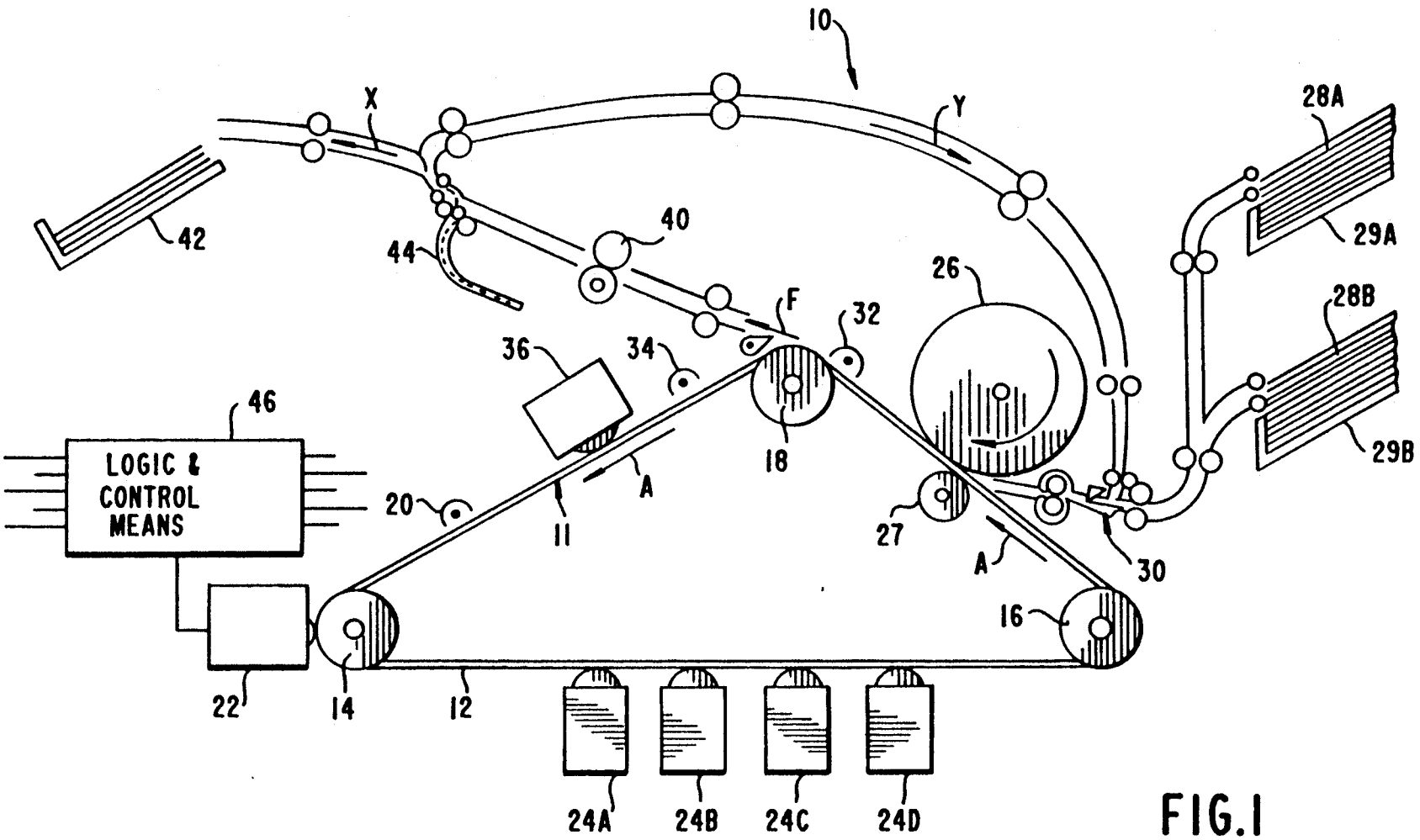
FIG. 1 is a schematic of a side elevation view of an electrostatographic reproduction machine such as a printer including the registration mechanism of the present invention.

Referring now to FIG. 1, an electrostatographic reproduction machine such as a printer is shown generally as 10 and is capable of operating in a simplex or duplex mode, that is, it is capable of producing images on one or both sides of a copy sheet or substrate. As shown, the printer 10 includes an image bearing member or photoconductor 11 that has a frontside image bearing surface 12 on which a plurality of images can be formed, including first and second images for duplex copying and transfer onto opposite sides of a receiver sheet. The member 11 for example is a continuous flexible web that is trained along a fixed path about a series of rollers 14, 16 and 18 for movement in the direction of the arrow A. One of the rollers, 14, 16, or 18 can be a drive roller, suitably driven by a conventional drive (not shown) for repeatedly moving the member 11 about the rollers 14, 16, 18 past a plurality of electrostatographic process or operating stations. Although the image-bearing member 11 is shown as a flexible web, it should be understood that a rigid rotatable drum that has an image bearing or photoconductive surface can also be used.

As shown in FIG. 1, with the image bearing member 11 moving in the direction of the arrow A, a first operating or process station includes a, primary charger 20, which is used for charging each section of the image bearing surface 12, passing thereunder, with a generally uniform electrostatic charge. At a next station, a latent image, for example a charge image of an original document, is formed on the charged section of the surface 12 by means for example of an electronic print head 22 which imagewise discharges portions of the charged section of the surface 12. In optical copiers, such a latent image can be formed instead using optical means, as is well known. Where plural color images are to be formed, several color separation latent images may be formed on the surface 12.

The latent image is next moved to where a development apparatus shown for example as 24A developes or makes the image visible using toner particles. A plurality of additional such development apparatus are shown as 24B, 24C and 24D and may also be used similarly, as is known, when producing visible multicolor images. Each of such development apparatus 24A–24D contains developer material for example of a different color. Such developer material may consist of fusible toner particles only, or of a mixture of such toner particles and carrier particles. During image development, as is well known, the toner particles transfer onto the latent image on the surface 12 thus making the image visible.

Downstream of the development apparatus 24A–24D, the developed or toned image on the section of the surface 12 is transferred, using transfer means shown as 26, onto a first side of a suitable receiver substrate 28A or 28B. The substrate either 28A or 28B is fed for example from a respective selected supply source 29A, 29B of such substrates or sheets to the registration mechanism of the present invention shown generally as 30 (to be described below) and then to the transfer means 26. The subtrate may be carried about the transfer drum 26 in a registered manner one or more times for receiving plural color toner images. The transfer means 26, for example can be a transfer drum 26, which operates over a back up roller 27. The substrate 28A, 28B may be plain paper or plastic transparency discrete sheets stored in each supply source 29A, 29B.

After such image transfer, a transfer detack charger 32 is used to assist in effecting separation of the image carrying substrate 28A, 28B from the surface 12. Thereafter, the particular section of the surface 12 of member 11 from which the image has been transferred continues around the roller 18 past a preclean assist charger 34 which charges or neutralizes residual charges on such section, and then past a cleaning apparatus 36 which removes residual particles from such section.

Meantime, the image carrying substrate 28A, 28B is fed away from the surface 12 in the direction of the arrow F towards a fusing apparatus 40. The toner image on the substrate is fused at the fusing apparatus 40 in order to form a hard copy. Such substrate 28A, 28B is then fed from the fusing apparatus 40 either in the direction of the arrow X to an output tray or in the direction of the arrow Y for return through the registration mechanism 30 of the present invention, and to the transfer means 26.

As is well known, when the reproduction machine 10 is operating in a simplex mode, the substrates 28A, 28B which each carry a fused image only on a first side thereof, are each fed after fusing in the direction of the arrow X to an output tray 42 for example. When the reproduction machine 10, on the other hand, is operating in a duplex mode, a substrate 28A, 28B which is carrying a fused image on its first side when leaving the fusing apparatus 40, is first inverted or turned over by means such as a J-shaped turnover mechanism 44. The turned over substrate is then fed in the direction of the arrow Y by suitable sheet feeding means back through the registration mechanism 30 to the transfer drum 26 to receive a second image on its second side. As described above, the image receiving second side of such a duplex substrate is then separated from the surface 12 in the same manner as the first side thereof was earlier separated therefrom. The duplex substrate is then again fed away from the surface 12 in the direction of the arrow F to the fusing apparatus 40 for fusing of such second image on the second side thereof. Following the fusing of such second image, the fully-or duplex-imaged sheet is then fed in the direction of the arrow X to the output tray 42 for example. The method and manner of transferring duplex images as described herein is exemplary only, and other methods and apparatus may also be used.

As is well known, the reproduction machine or printer 10 includes logic and control means shown as 46 for controlling the timing and functioning of the various operating components and modes of the machine or printer 10.

Referring now to FIGS. 2–5, the registration mechanism 30 of the present invention is shown and includes first and second plate-face members 52, 54 respectively which define a sheet travel path 56. Relative to the direction of sheet travel, the registration mechanism 30 also includes an upstream, first sheet feeding means 58 and a downstream, second sheet feeding means 60, for feeding receiver sheets, 28B for example, seriatim along the path 56 in the direction of the arrow 62. The registration mechanism further includes a releasable stop means 64 that is positioned to stop and align the lead edge of a sheet 28B immediately upstream of the second sheet feeding means 60. For registering the sheet relative to a moving toner image on the surface 12, the stopped sheet can then be released by the stop means in timed relation with such image for feeding by the second sheet feeding means to the moving image on the surface 12.

In order to prevent skewing and wrinkling of the released sheet 28B feeding into and through the second sheet feeding means 60, the registration mechanism 30 further includes sheet-path zigzagging means shown generally as 66 for increasing the beam strength of the sheet 28B as the sheet 28B feeds into the second feeding means 60. As shown, the path zigzagging means 66 are located within the sheet travel path 56 between the upstream, first sheet feeding means 58 and the releasable stop means 64.

Figure 2:
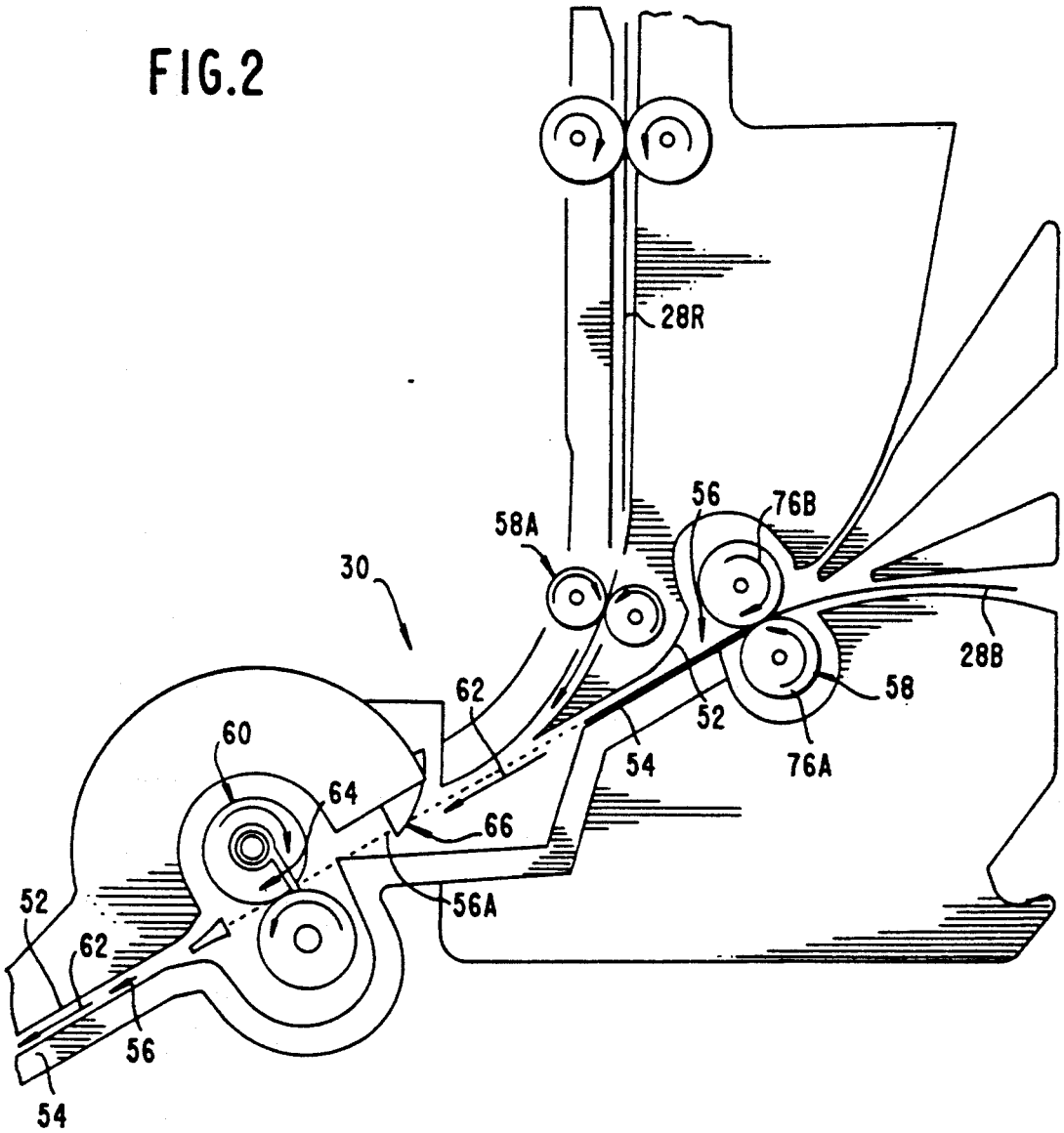
FIG. 2 is a close-up schematic view of the registration mechanism of FIG. 1 including the path zigzagging means of the present invention.

Referring to FIG. 2, the zigzagging means 66 are located within the path 56 so as to be downstream of an entry point into the path 56 for sheets, for example the sheet shown as 28R, being returned with the help of means 58A from the fusing apparatus 40 to the transfer means 26 (FIG. 1) during duplex-imaging. Such a sheet 28R or the sheet 28B when being fed into and through the downstream sheet feeding means 60, ordinarily will tend to follow a straight line 56A within the sheet path 56. In accordance with the present invention, the zigzagging means 66 are located within the sheet path 56 such that a part of such means 66 projects from the first plate-face member 52 significantly across the straight line 56A, thereby changing or altering the path of a feeding sheet 28B from such straight line 56A.

Figure 3:
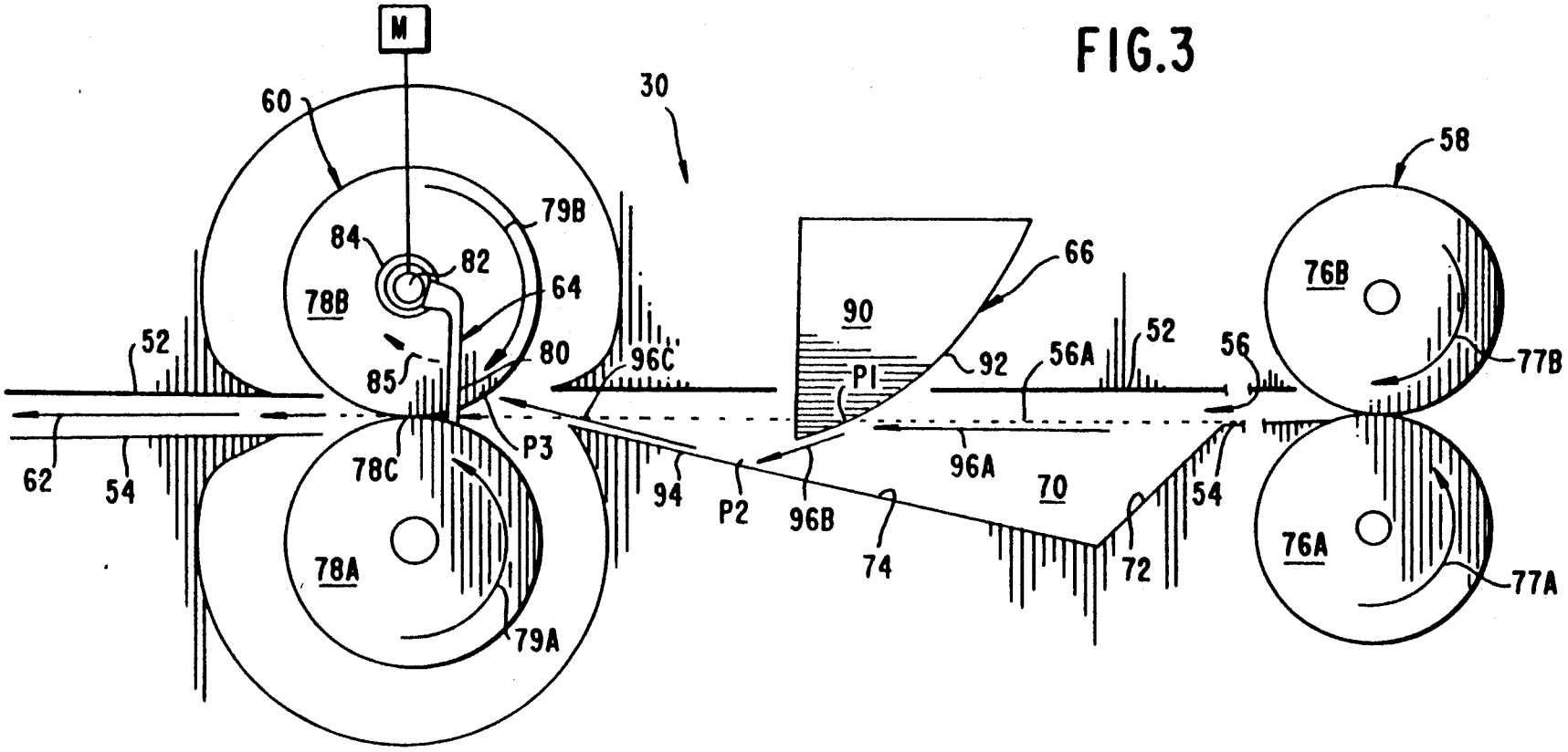
FIG. 3 is a view similar to that of FIG. 2 diagrammatically showing the ziggag travel path of a sheet according to the present invention.
Figure 4:
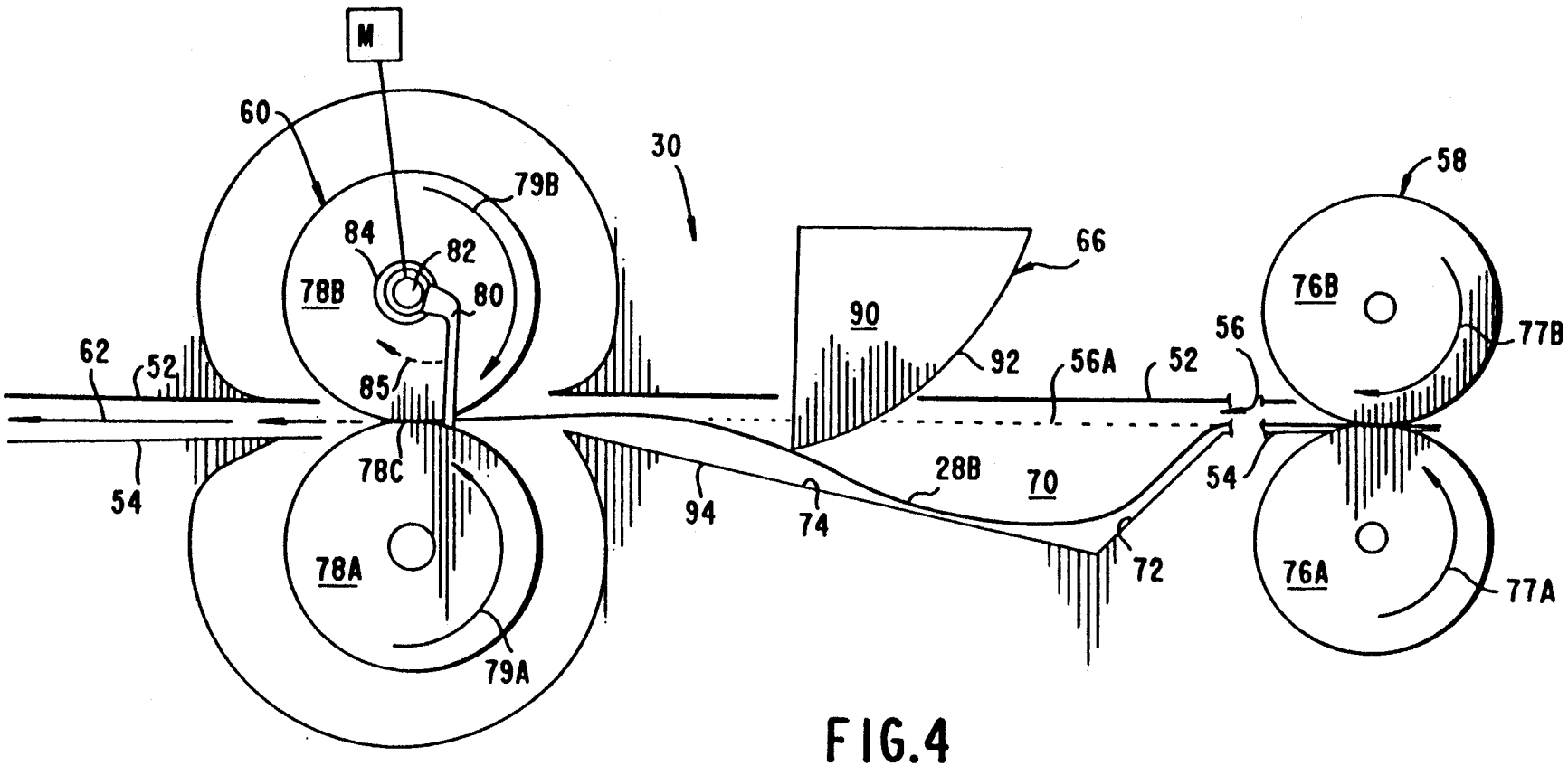
FIG. 4 is a view similar to that of FIG. 3 and illustrating a sheet fed and buckled according to the present invention.

Referring now to FIG. 3 and 4, the registration mechanism 30 is shown including a structure that is shaped to define a sheet-buckling open area or pocket 70 that is formed upstream of the stop means 64, and which adjoins and opens from the sheet travel path 56 into the second plate-face member 54. As shown, the buckling area or pocket 70 is defined by a pair of surfaces 72, 74 which both slant from the deepest point of the pocket back to the sheet path 56. Located as such, the buckling area or pocket 70 is suitable for receiving the buckled portion of a sheet 28B (FIG. 4) that has been fed and buckled against the stop means 64 by the upstream sheet feeding means 58. As is known in the art, such buckling is achieved by positioning the upstream sheet feeding means 58 at a distance from the stop means or member 64 which is substantially less than the intrack dimension of the sheet 28B.

The upstream sheet feeding means 58 for example can comprise a pair of nip forming rollers 76A, 76B which are selectively driven by means (not shown) in the manner shown by the arrows 77A, 77B for feeding sheets 28A, 28B seriatim towards the downstream sheet feedings means 60. The downstream sheet feedings means for example can also be a pair of nip forming rollers 78A, 78B which too are selectively driven by means (not shown) for rotation as shown by the arrows 79A, 79B. When the rollers 78A, 78B can be selectively driven as such or stopped, they may function as the means for stopping the lead edge of the sheet 28B being fed from the upstream means 58. Selective stopping and rotation of the rollers as such will cause the sheet 28B to be stopped and buckled, and to be fed therethrough downstreamward to the transfer means 26 (FIG. 1). Accordingly, when used as the stopping means, the rollers 78A, 78B should be positioned such that they form a sheet feeding nip 78C that is at a distance from the means 58 which also is less than the intrack dimension of the sheet 28B.

Figure 5:
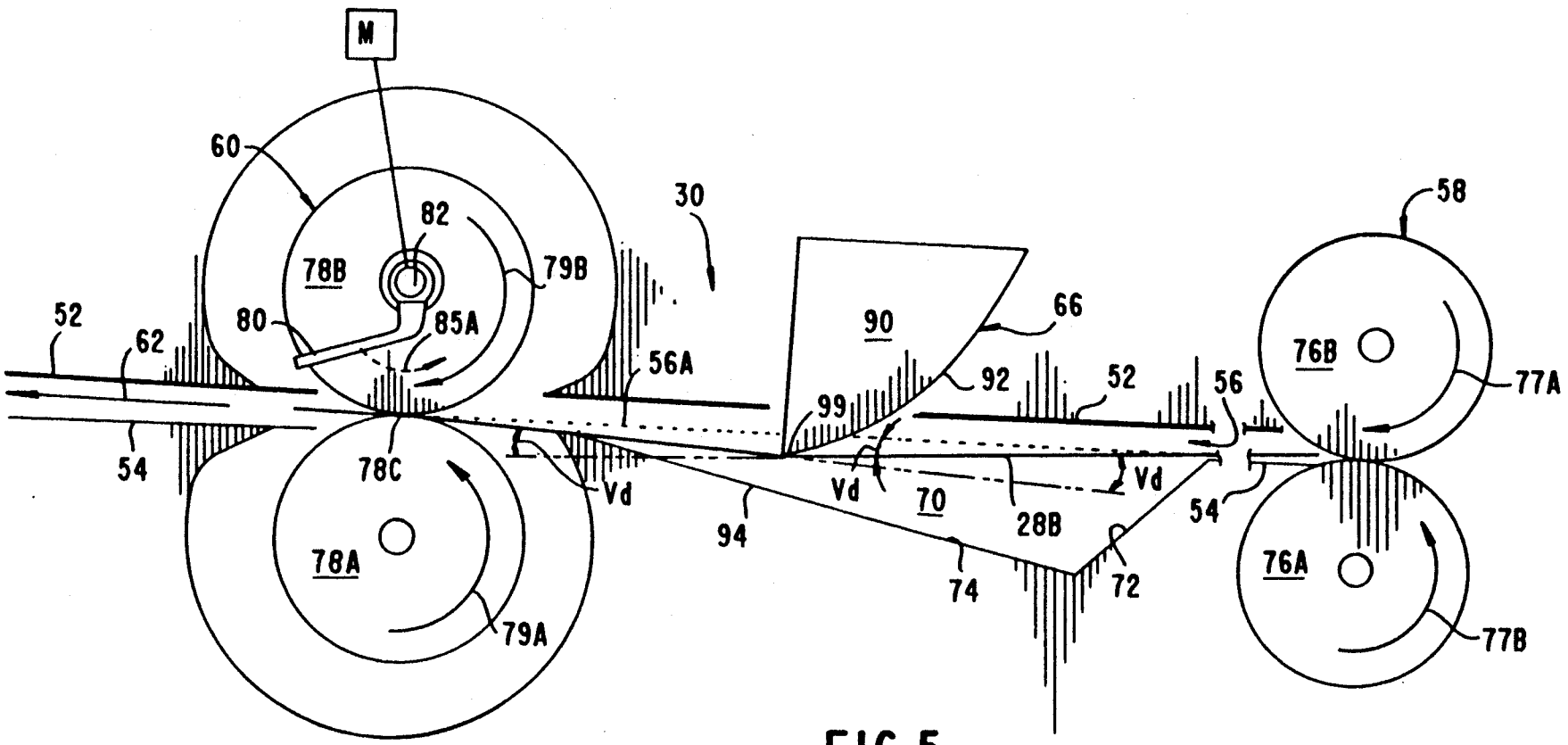
FIG. 5 is a view similar to that of FIG. 4 and showing a sheet being fed out of the registration mechanism of the present invention.

As shown however, the registration mechanism 30 includes the stop means 64 shown as a pivotable registration gate or finger 80 that is positioned immediately upstream of the sheet feeding nip 78C for stopping and aligning-. the lead edge of the sheet 28B being fed by the first, upstream sheet feeding means 58. The registration gate or finger 80 may be mounted on a stub shaft 82 which is separate from a drive shaft 84 of the roller 78B of the downstream sheet feeding means 60. The gate of finger 80 as mounted should be pivotable (by means for example of a drive M) in the direction of the arrow 85. Accordingly, the gate or finger 80 has a sheet stopping position as shown for example in FIG. 4 when such finger or gate projects across the sheet travel path 56, and a timed registration sheet releasing position, as shown in FIG. 5, away from the path 56. When the gate or finger 80 is used as the means for stopping the lead edge of a fed sheet 28B, the rollers 78A, 78B of the second, downstream sheet feeding means 60 may be driven continuously for receiving and feeding the sheet 28B when it is released in timed relation with a toner image by the pivoted finger 80.

As further shown, the zigzagging means 66 comprises a first sheet deflecting member 90 which has an upstream surface 92, and at least a second sheet deflecting member 94 which as shown includes the slanted surface 74. The first sheet deflecting member 90 is positioned downstream of the upstream sheet feeding means 58 across from a portion of the buckling area 70, and such that it partially and transversely projects from the first plate-face member 52 into the sheet travel path 56. The sheet deflecting member 90 should project as such so that it reaches from the plate-face member 52 beyond the straight line 56A within the path 56. The upstream surface 92 of the member 90 should slant downstreamwards so as to deflect the lead edge of a fed sheet forwardly, but in the direction of the second plate-face member 54.

For example a sheet 28B fed by the means 58 should travel in the direction of the arrow 96A until it strikes the surface 92 at a point shown as P1. The sheet 28B should be deflected at the point P1 such that it makes a sharp turn in the direction of the arrow 96B and there travels until it strikes the forwardly or downstreamward slanting surface 74 at a point P2. The sheet should be deflected at the point P2 such that it makes another turn forwardly, but (as shown by the arrow 96C), back in the direction of the first plate-face member 52. The slant of the surface 74 should be such as to cause the sheet 28B to deflect directly into downstream contact preferably with the roller 78B for example at a point P3. The point P3 should be located such that the lead edge of the sheet 28B can (if necessary) then slip over the surface of the roller 78B before coming to stop against the gate or finger 80 (which is in the sheet stopping position across the sheet path 56) for buckling as described above. As can be seen, the sheet 28B has moved essentially in a zigzag manner through the path 56 from the first feeding means 58 to the stop member 80.

Referring now to FIG. 5, the stop member or gate 80 can then be pivoted out of the way of the stopped and buckled sheet 28B thereby allowing the lead edge thereof to move forwardly into the sheet feeding nip 78C for feeding in timed relation or registration with an image on the image bearing surface 12 (FIG. 1). As shown, when the sheet 28B is feeding through the nip 78C, it is prevented by the projecting first sheet deflecting member 90 from assuming or traveling along the straight line 56A within the path 56. Instead, the sheet 28B as shown is deflected by the member 90 so that the sheet develops a significant transverse bend over a sharp edge 99 of the member 90. The sheet as such forms an angle Vd for example with the straight line 56A. Effectively, the edge 99 of the member 90 puts a transverse bend into the sheet 28B as it feeds into the nip 78C. With such bending, the length or intrack dimension of the free or unsupported portion of the sheet 28B immediately upstream of, and feeding into the nip 78C, is significantly shortened. As shown, the shorter unsupported portion of the sheet 28B is that which lies between the nip 78C and the sharp point 99 of the member 90. By shortening the length or intrack dimension of the unsupported portion of the sheet 28B feeding into the nip 78C, the beam strength of such a shorter portion becomes significantly greater than that of a full intrack dimension feeding into the nip 78C, for example along the straight line 56A. Increasing the beam strength of that shorter portion of the sheet 28B feeding from the sharp point 99 to the nip 78C effectively prevents any tendency, over that same portion of the sheet 28B, for folding or bending in the cross-track direction. As a result the entire sheet 28B can be fed into and through the nip 78C without significant skewing, and hence without significant wrinkling.

The invention has been described in detail with particular reference to a presently preferred embodiment, but it will be understood that variations and modifications can be effected within the spirit and scope of the invention.

What is claimed is:

1. In an electrostatographic reproduction apparatus having means including a moving image bearing member for forming and transferring toner images to a moving receiver sheet, a registration mechanism for registering the sheet, the registration mechanism comprising:

(a) first and second plate-face members defining a sheet travel path;

(b) an upstream sheet feeding means and a downstream sheet feeding means positioned within said sheet path for feeding sheets seriatim along said sheet path;

(c) releasable stop means positioned within said sheet travel path immediately upstream of said downstream sheet feeding means for stopping and aligning the lead edge of a sheet fed by said upstream sheet feeding means; and (d) sheet-path zigzagging means including a first sheet deflecting member separate from said first and second plate-face members, said first sheet deflecting member being mounted from said first plate-face member and projecting into said sheet travel path between said stop means and said upstream sheet feed means for putting a bend into a sheet feeding through said downstream sheet feeding means, thereby increasing the beam strength of, and removing transverse folds from a free and unsupported portion of the sheet feeding downstream of said bend and into said downstream sheet feeding means.

2. The registration mechanism of claim 1 wherein said first sheet deflecting member is positioned downstream of said upstream sheet feeding means and projecting partially and transversely from said first plate-face member into said sheet path for deflecting a feeding sheet towards said second plate-face member.

3. The registration mechanism of claim 2 wherein said sheet path zigzagging means further includes a second sheet deflecting member located downstream of said first sheet deflecting member on said second plate-face member for deflecting such sheet back substantially towards said first plate-face member.

4. The registration mechanism of claim 3 wherein said first sheet deflecting member includes an upstream surface having a downstreamward slant.

5. The registration mechanism of claim 3 wherein said second sheet deflecting member includes a slanted surface.

6. The registration mechanism of claim 5 including a sheet-buckling open area formed upstream of said stop means and opening from said sheet travel path into said second plate-face member for receiving a buckled portion of a sheet fed and buckled against said stop means by said upstream sheet feeding means.

7. An electrostatographic reproduction apparatus including:

(a) means for forming a toner image on a moving image bearing member;

(b) means for transferring the toner image onto a receiver sheet;

(c) means for feeding the receiver sheet along a sheet travel path to said image transferring means; and (d) sheet registration means for registering a moving receiver sheet relative to said moving image bearing member, the registration means comprising:

(i) a registration gate;

(ii) means for feeding the receiver sheet along the sheet travel path to said registration gate; and (iii) sheet path zigzagging means for putting a bend into the feeding sheet immediately upstream of said registration gate so as to increase the beam strength of the sheet feeding to said registration gate, said zigzagging means including a first sheet deflecting member being positioned downstream of said sheet feeding means and projecting into the sheet travel path beyond a straight line within said path drawn in the direction of sheet travel through a sheet feeding nip of a second downstream sheet feeding means for deflecting the feeding sheet substantially transversely in a first direction, and a second sheet deflecting member being positioned downstream of said first sheet deflecting member for deflecting such sheet substantially transversely in a second direction opposite to said first direction.

8. In a reproduction apparatus, a mechanism for preventing wrinkling sheets registered in a sheet registration assembly, the mechanism comprising:

(a) first and second plate-face members defining a first sheet-travel path, said first sheet-travel path including a sheet buckling region formed in said second plate-face member;

(b) first and second sheet feeding means, located across said first sheet-travel path upstream and downstream respectively of said sheet buckling region relative to sheet travel, for feeding the full intrack dimension of a sheet along said first sheet-travel path, said second, downstream sheet feeding means being located to receive and feed a free and unsupported intrack portion of a sheet from said first, upstream feeding means; and (c) a first sheet deflecting member, separate from said first and second plate-face members, said first sheet deflecting member being mounted from said first plate-face member across from said buckling region and having a portion thereof projecting significantly into said first sheet-travel path, and said projecting portion of said first sheet deflecting member having a sharp edge for creating a sharp bend in a sheet feeding into and through said downstream sheet feeding means, thereby removing transverse folds in said sheet and preventing wrinkling therein.

9. The mechanism of claim 8 wherein said separate, first sheet deflecting member is located so as to make the free and unsupported intrack portion of a sheet, feeding into said downstream sheet feeding means, substantially shorter than the full intrack dimension of such sheet, thereby increasing the beam strength of such free and unsupported portion thereof.

10. The mechanism of claim 8 wherein said projecting portion of said sheet deflecting member projects across a straight line drawn in the direction of sheet travel through a sheet feeding nip of said second, downstream sheet feeding means.

* * * * *